US009695570B2

(12) United States Patent
Ito

(10) Patent No.: US 9,695,570 B2
(45) Date of Patent: Jul. 4, 2017

(54) WORKING VEHICLE

(71) Applicant: Takeuchi Mfg. Co., Ltd., Nagano (JP)

(72) Inventor: Shusaku Ito, Sakaki-machi (JP)

(73) Assignee: TAKEUCHI MFG. CO., LTD., Nagano (JP)

( * ) Notice: Subject to any disclaimer, the term of this patent is extended or adjusted under 35 U.S.C. 154(b) by 0 days.

(21) Appl. No.: 14/754,151

(22) Filed: Jun. 29, 2015

(65) Prior Publication Data

US 2016/0024748 A1 Jan. 28, 2016

(30) Foreign Application Priority Data

Jul. 28, 2014 (JP) ..... 2014-152554

(51) Int. Cl.
*E02F 3/42* (2006.01)
*E02F 3/34* (2006.01)

(52) U.S. Cl.
CPC ..... *E02F 3/422* (2013.01); *E02F 3/34* (2013.01); *E02F 3/3414* (2013.01)

(58) Field of Classification Search
CPC ..... E02F 3/422; E02F 3/3414; E02F 3/34
See application file for complete search history.

(56) References Cited

U.S. PATENT DOCUMENTS 6,474,933 B1 11/2002 Hoechst et al.
6,854,951 B2 2/2005 Mimuro
2006/0243234 A1 11/2006 Shibuya
2007/0104566 A1 5/2007 Layko et al.
2007/0128012 A1 6/2007 Yamada et al.
2010/0143086 A1 6/2010 Yasuda et al.

FOREIGN PATENT DOCUMENTS

JP 2006-307498 A 11/2006

OTHER PUBLICATIONS

European search report (under R. 61 and R. 63 EPC) issued by the European Patent Office on Feb. 18, 2016, which corresponds to European Patent Application No. 15174485.1-1712 and is related to U.S. Appl. No. 14/754,151.

European Office Action issued by the European Patent Office on Mar. 7, 2016, which corresponds to European Patent Application No. 15174485.1-1712 and is related to U.S. Appl. No. 14/754,151.

*Primary Examiner* — Scott Lowe
(74) *Attorney, Agent, or Firm* — Studebaker & Brackett PC

(57) ABSTRACT

In a state in which an arm 21 is oscillated to a lowest position, each control link 22 is arranged to be horizontally extended backward where the control link 22 is pivotally connected to a point A, and is pivotally connected to the arm 21 at a point D. An arm cylinder 23 is arranged to be vertically extended upward where the arm cylinder 23 is pivotally connected to a point B, and is pivotally connected to the arm 21 at a point E. The lift link 24 is arranged to be vertically extended upward where the lift link 24 is pivotally connected to a point C, and is pivotally connected to the arm 21 at a point F. The points E and F are located above the point D.

6 Claims, 8 Drawing Sheets

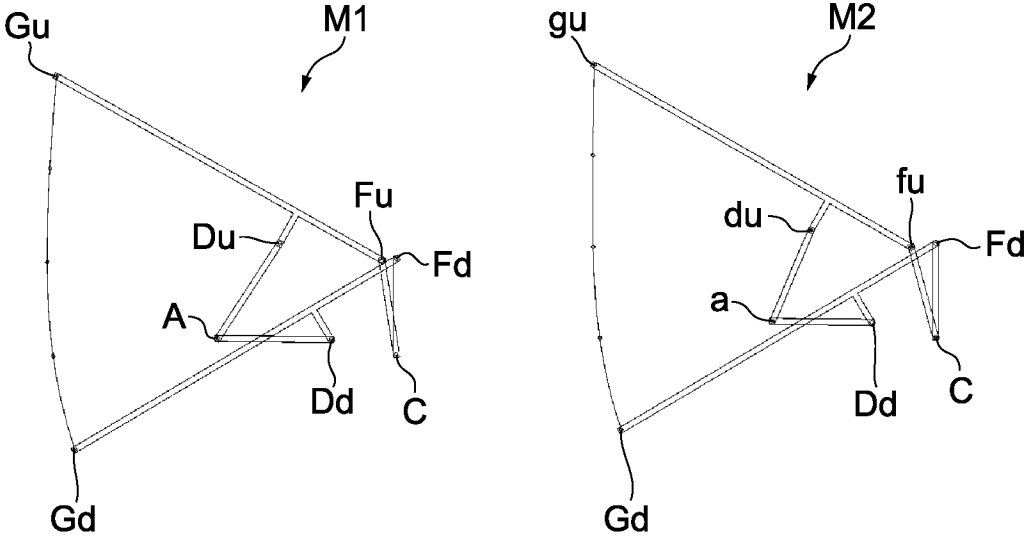
FIG.6A
FIG.6B
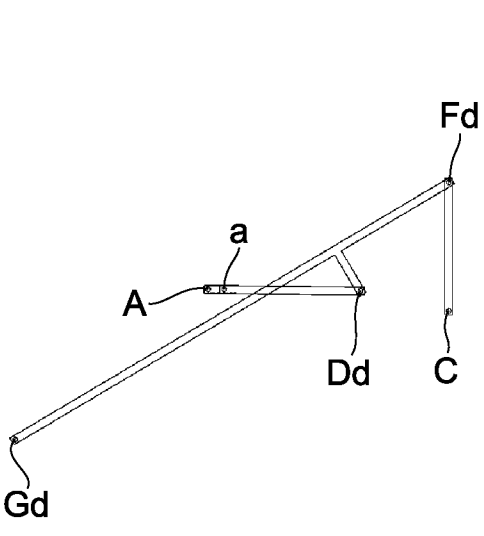
FIG.6C
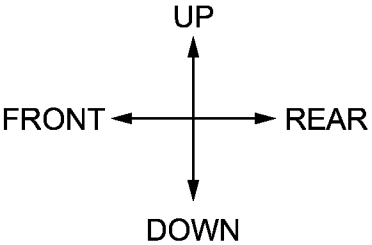

WORKING VEHICLE

RELATED APPLICATIONS

This invention claims the benefit of Japanese Patent Application No. 2014-152554 which is hereby incorporated by reference.

TECHNICAL FIELD

The present invention relates to a working vehicle in which an arm is provided on a runnable vehicle main body so as to freely oscillate vertically, and which performs a work by vertically moving an attachment (a working device) detachably installed on an arm front end by vertically oscillating the arm.

TECHNICAL BACKGROUND

As an example of such a working vehicle, there has been known a skid steering loader in which running devices configured by tires or crawlers are provided on both left and right sides of the vehicle main body such that the traveling direction of the working vehicle is changed by making working speeds of the left and right running devices different. An arm supporting mechanism that is provided in the skid steering loader and vertically oscillates the arm is broadly classified into: a radial type supporting mechanism in which the arm is supported by pivotally connecting the base end part of the arm to the vehicle main body; and a vertical type supporting mechanism in which the arm is supported by pivotally connecting the base end part of the arm to the vehicle main body by using two links, the vertical type supporting mechanism being configured such that the vehicle main body, the arm and two links constitute a planar closed four-link mechanism in a side view. Generally, the vertical type supporting mechanism is configured by using the two links as described above. This supporting mechanism is referred to as the "vertical type" because many supporting mechanisms of this type have an arm front-end orbit which is substantially perpendicular to the ground as compared with the radial type.

Both U.S. Pat. No. 6,474,933 and U.S. Laid-Open Patent Publication No. 2007/0104566(A) disclose working vehicles, each equipped with a vertical type arm. Each working vehicle is configured to have the arm supported to the vehicle main body by two front and rear link members, and have the arm vertically oscillated according to expansion and contraction of a hydraulic cylinder arranged to stride over the arm and the vehicle body. In the case of the radial type supporting mechanism, the arm vertically oscillates around the pivotal connection point between the arm and the vehicle body. Therefore, the arm front end (and the attachment such as a bucket installed on the arm front end) vertically moves while drawing an arc centered on the pivotal connection point as viewed from the side of the vehicle. On the other hand, according to the vertical type, by changing the lengths of the two links and the pivotal connection positions to the arm and the vehicle body, a movement locus of the arm front end according to the vertical movement of the arm can be set relatively freely.

A loader of the skid steering type or the like (a loading working vehicle) has a bucket installed on the arm front end, for example, and is used for scooping out gravels and the like into the bucket and loading the gravels onto a carrying vehicle such as a dump truck. In the loading work, first, the arm is lowered and also the own vehicle is run and the bucket is oscillated, such that gravels are scooped into the bucket. Then, after the own vehicle is run to near the carrying vehicle such as the dump truck, the gravels are loaded onto the cargo stand on the carrying vehicle by running the own vehicle and oscillating the bucket while lifting the arm. When performing this loading work, in the case of the loader using the radial type supporting mechanism, the bucket installed on the arm front end is lifted while drawing an arc. Therefore, the bucket is lifted from the arm lowered position to a horizontal position while moving forward, and is lifted from the horizontal position to the arm-lifted position while moving back. In this case, the arm is located foremost at the horizontal position. Therefore, in order to avoid interference with the dump truck, the own vehicle needs to be located at a certain distance from the dump truck. However, in loading the gravels from the bucket onto the dump truck after the bucket is lifted, the bucket needs to be located on the cargo stand on the dump truck by moving the own vehicle forward. The bucket is retreated at the arm-lifted position as described above, the distance over which the own vehicle moves forward therefore becomes large. In the case of the loader using the radial type supporting mechanism, the bucket installed on the arm front end is lifted and lowered while drawing an arc forming a convex shape toward the front. Therefore, particularly when the arm is vertically oscillated in the state in which a heavy object is loaded in the bucket, there is a risk that the vehicle overturns forward.

On the other hand, when the vertical type supporting mechanism is used, the supporting mechanism can be configured to move the arm front end (and the bucket installed on the arm front end) so as to draw a substantially vertical locus when vertically oscillating the arm. By this arrangement, the arm can be vertically oscillated by bringing the own vehicle closer to the dump truck, and the forward movement distance of the own vehicle at the time of loading the gravels from the inside of the bucket onto the dump truck by lifting the bucket can be made small. Therefore, efficient loading work becomes possible. For the above reason, there have been used many working vehicles employing the vertical type supporting mechanism. Further, the vertical type supporting mechanism can be configured to move the arm front end (and the bucket) to draw a substantially vertical locus, as compared with the radial type supporting mechanism. This configuration capable of reducing the risk of the own vehicle overturning forward when the arm is vertically oscillated is one of the advantages of the vertical type over the radial type.

In U.S. Pat. No. 6,474,933, for example, discloses a vertical type supporting mechanism in which, when the arm is lifted from the lowered position, the arm front end draws an S shaped locus such that, after being lifted while slightly moving forward, the arm front end is further lifted while slowly moving back, and again lifted while moving forward in the middle. In the working vehicle according to U.S. Laid-Open Patent Publication No. 2007/0104566(A), the arm is configured such that, when the arm is vertically oscillated, the arm front end moves reciprocally longitudinally in an M shape.

In the case of employing the vertical type supporting mechanism, because of high degrees of freedom of the lengths of the two links and the hydraulic cylinder (the arm cylinder) and the arrangement position (pivotal connection positions to the arm and the vehicle body), how to set these items is important. Based on the setting of these items, the appearance design and the structure of the vehicle as a whole change, and also the movement locus of the arm front end changes. The appearance design and the structure are required to be simple as far as possible and to have a good appearance. Regarding the movement locus of the arm front end, considering the loading work described above, vertical movement of the arm front end is required. However, as in the working vehicle in U.S. Pat. No. 6,474,933, if the arm front end is located at a front position when the arm is oscillated to a high moving position, although the distance over which the own vehicle moves for loading onto the carrying vehicle becomes short, the vehicle receives the influence of the weight of the bucket cargo and becomes unstable at the time of lifting the arm. Further, in the case of U.S. Pat. No. 6,474,933, the bucket movement locus forms the S shape, and in the case of U.S. Laid-Open Patent Publication No. 2007/0104566 (A), the bucket movement locus forms longitudinal movement in the M shape. This has a problem in that the weight center of the vehicle changes longitudinally following the oscillation of the arm, and the working vehicle cannot be easily operated (has poor operability).

The present invention has been made in view of the above problems. An object of the present invention is to provide a working vehicle with excellent stability and operability of the vehicle at the time of vertically oscillating an arm, by allowing a movement locus of an arm front end following a vertical oscillation of the arm to be substantially vertical and by suppressing the movement amount in the longitudinal direction.

SUMMARY OF THE INVENTION

In order to achieve the above object, a working vehicle according to the present invention includes: a running vehicle capable of running; an arm installed vertically oscillatably on the running vehicle; and a supporting mechanism for vertically oscillatably supporting the arm on the running vehicle. The supporting mechanism includes control links disposed so as to stride over the arm and the running vehicle, an arm cylinder, and a lift link, and is configured to vertically oscillate the arm by expanding and contracting the arm cylinder. In this working vehicle, a positional relationship in a vehicle longitudinal direction between pivotal connection points A, B, and C provided in the running vehicle and respectively connecting the running vehicle with one end part of each of the control links, with one end part of the arm cylinder, and with one end part of the lift link is such that: the pivotal connection point A is located on a foremost side of the vehicle, the pivotal connection point B is located on a rear side of the pivotal connection point A, the pivotal connection point C is located on a rear side of the pivotal connection point B, and the pivotal connection point B is located below the pivotal connection points A and C; the pivotal connection point A is located at an intermediate part of the running vehicle, and the pivotal connection points B and C are located adjacent to each other in a rear part of the running vehicle; and a distance between the pivotal connection point A and the pivotal connection point B is greater than a distance between the pivotal connection point B and the pivotal connection point C. In the state in which the arm is oscillated to a lowest position, each of the control links is arranged to be approximately horizontally extended backward from one end side where the control link is pivotally connected to the pivotal connection point A, and is pivotally connected to the arm at a pivotal connection point D on the other end side of the control link, the pivotal connection point D being located closest to the pivotal connection pint B. The arm cylinder is located on a rear side of the pivotal connection point D, is arranged to be approximately vertically extended upward from one end side where the arm cylinder is pivotally connected to the pivotal connection point B, and is pivotally connected to the arm at a pivotal connection point E on the other end side of the arm cylinder. The lift link is located on a rear side of the arm cylinder so as to be adjacent to the arm cylinder, is arranged to be extended approximately parallel to the arm cylinder and approximately vertically upward from one end side where the lift link is pivotally connected to the pivotal connection point C, and is pivotally connected to the arm at a pivotal connection point F on the other end side of the lift link. The pivotal connection points E and F are located above the pivotal connection points A and D.

In the working vehicle, preferably, the pivotal connection point A is located above the pivotal connection point C.

In the working vehicle, preferably, in the state in which the arm is oscillated to the lowest position, each of the control links is extended backward and downward from one end side where the control link is pivotally connected to the pivotal connection point A.

In the working vehicle, preferably, in the state in which the arm is oscillated to the lowest position, the pivotal connection point F is located above the pivotal connection point E.

In the working vehicle, preferably, when oscillating the arm from the state in which the arm is oscillated to the lowest position to a state in which the arm is oscillated to an uppermost position via an intermediate oscillation position, a front end part of the arm moves forward following upward oscillation of the arm until the arm reaches the intermediate oscillation position from the state in which the arm is oscillated to the lowest position; the front end part of the arm moves backward following the upward oscillation of the arm until the arm reaches the state in which the arm is oscillated to the uppermost position from the intermediate oscillation position; and the front end part of the arm in the state in which the arm is oscillated to the lowest position is located on a rear side of the front end part of the arm in the state in which the arm is oscillated to the uppermost position.

The working vehicle according to the present invention further includes, on left and right sides of the running vehicle, side-part frame members located on outer sides of the arm cylinder and the lift link and configured to cover the arm cylinder and the lift link.

According to the working vehicle relating to the present invention configured as described above, by employing what is called the vertical type supporting mechanism, when the arm has been oscillated upward from a low moving position, the working vehicle can be configured to be able to move the arm front end upward while smoothly moving the arm front end forward to the middle, and thereafter, move the arm front end upward smoothly and substantially vertically. Therefore, by configuring the working vehicle to move the arm front end upward while smoothly moving the arm front end forward to the middle, and thereafter, move the arm front end upward smoothly and substantially vertically, it is possible to obtain the working vehicle with excellent stability and operability of the vehicle at the time of vertically oscillating the arm. Further, each control link is extended substantially horizontally at the arm lowest moving position, and the arm cylinder and the lift link can be arranged in compact so as to be extended horizontally and vertically upward by bringing the arm cylinder and the lift link close to each other. As a result, a compact appearance design can be obtained.

Further, the working vehicle relating to the present invention has a configuration in which, at the arm lowest moving position, the control link is approximately horizontally extended backward, that is, a configuration in which the pivotal connection point D is located in approximately the same height as that of the pivotal connection point A. Therefore, in the configuration in which the control link is arranged to be extended upward toward the back from the pivotal connection point A, for example, it is possible to lower a position of a mechanical instantaneous center of the arm (also simply referred to as an "instantaneous center", and a center point when it can be regarded that the arm is performing a rotation movement around a certain point at a certain moment) in the state in which the arm is located near the lowest moving position. A moving speed of the arm front end is defined as a component in a direction orthogonal with a line component that connects an instantaneous center of the arm and the arm front end. Therefore, by lowering the instantaneous center position of the arm as described above, the arm front end can be moved substantially vertically, by suppressing forward movement of the arm front end when oscillating the arm near the lowest moving position, by minimizing a horizontal directional component of the moving speed of the arm front end. Consequently, the working vehicle with excellent vehicle stability can be obtained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only and thus are not limitative of the present invention.

FIGS. 6A, 6B, and 6C are skeleton diagrams for explaining a difference in the movement locus of the arm front end following a change in the length of the control link in a vertical type supporting mechanism used in the skid steering loader;

FIG. 8A is a skeleton diagram schematically illustrating a whole of the locus adjustment mechanism; FIG. 8B is a diagram illustrating an expansion-contraction control link configuring the locus adjustment mechanism; and FIG. 8C is a diagram illustrating a flexing control link as an alternative to the expansion-contraction control link.

DESCRIPTION OF THE EMBODIMENT

An embodiment of the present invention will be described below with reference to the drawings. In the present embodiment, there will be described an example of application of the present invention to a crawler type skid steering loader (hereinafter, referred to as a crawler loader 1) having a bucket mounted on the front end of the arm. First, a total configuration of the crawler loader 1 will be described with reference to FIGS. 1 to 3. In the following, for convenience of the description, front and rear, left and right, and above and below will be defined using arrow directions attached to the drawings.

Figure 1:
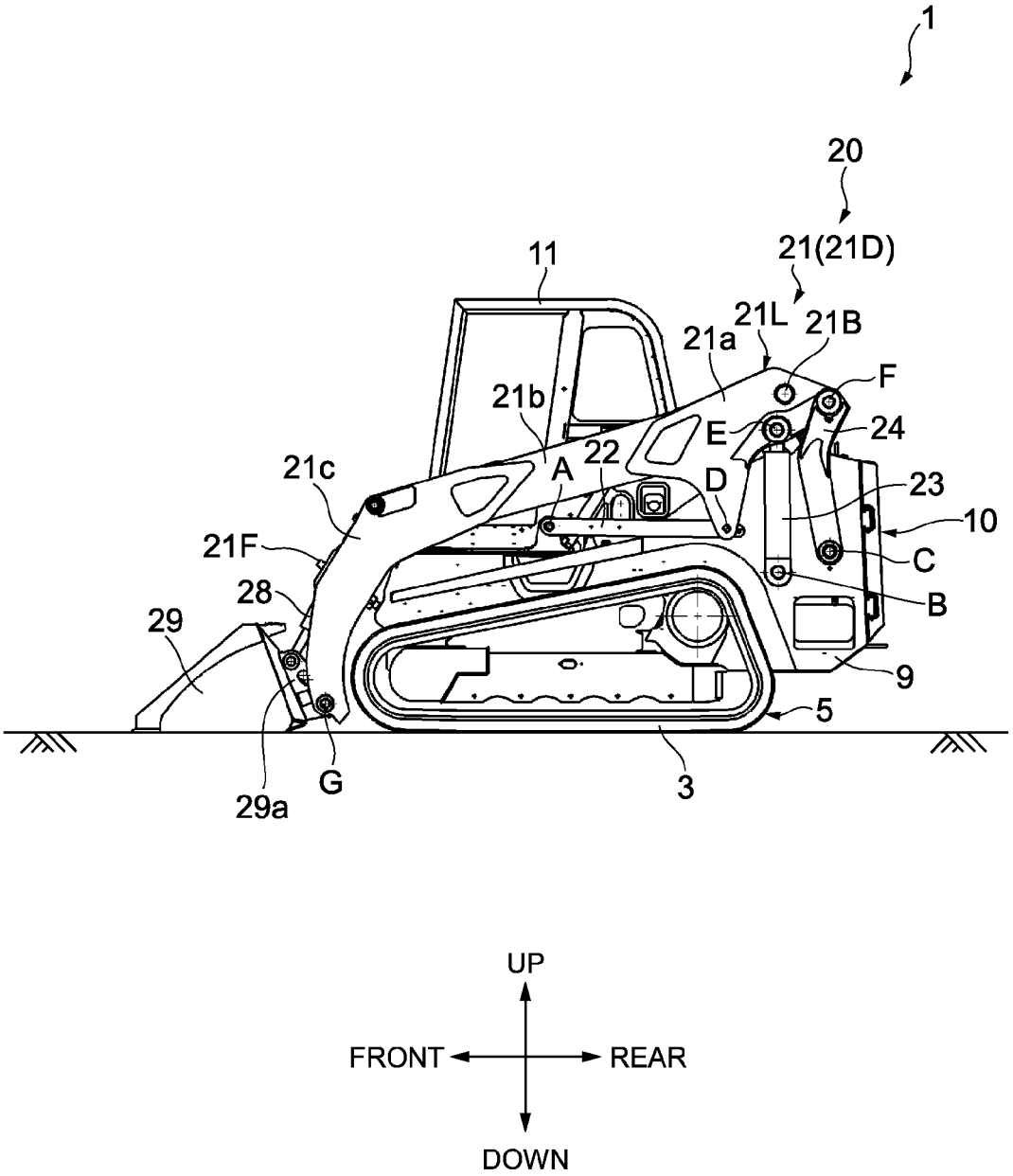
FIG. 1 is a left side view of a crawler type skid steering loader to which the present invention is applied, illustrating a state in which an arm is oscillated to a lowest moving position.
Figure 2A:
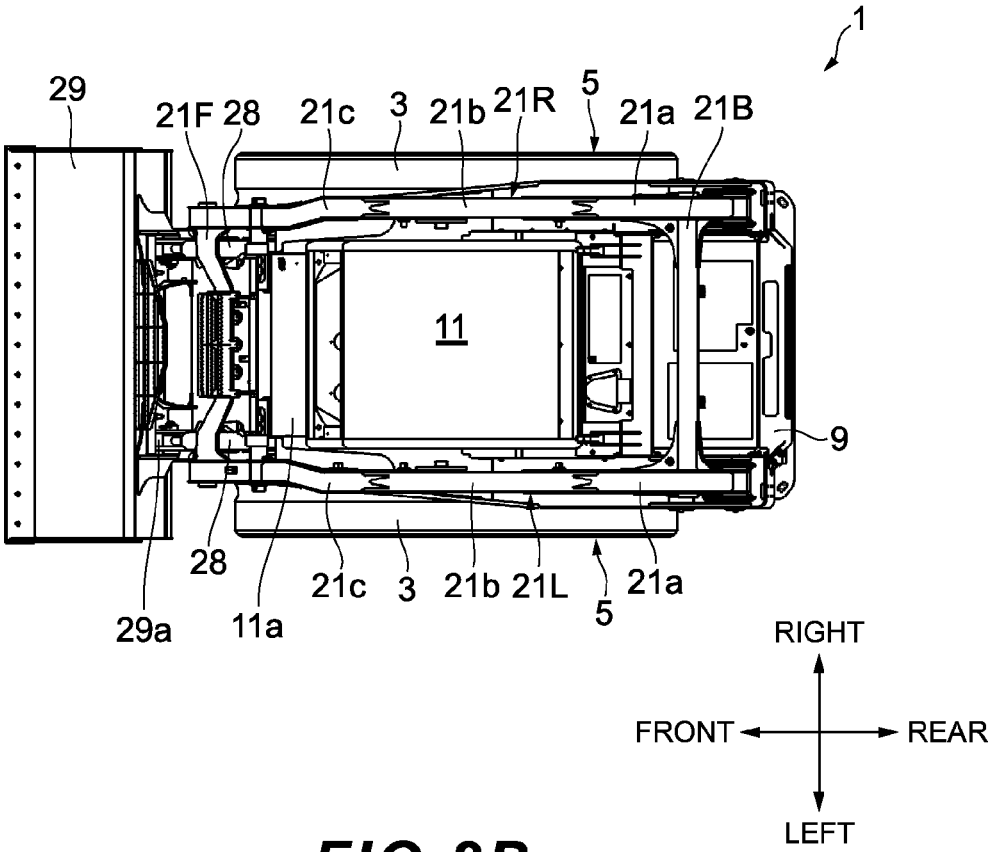
FIGS. 2A and 2B are a plan view and a front view, respectively, of the skid steering loader.
Figure 2B:
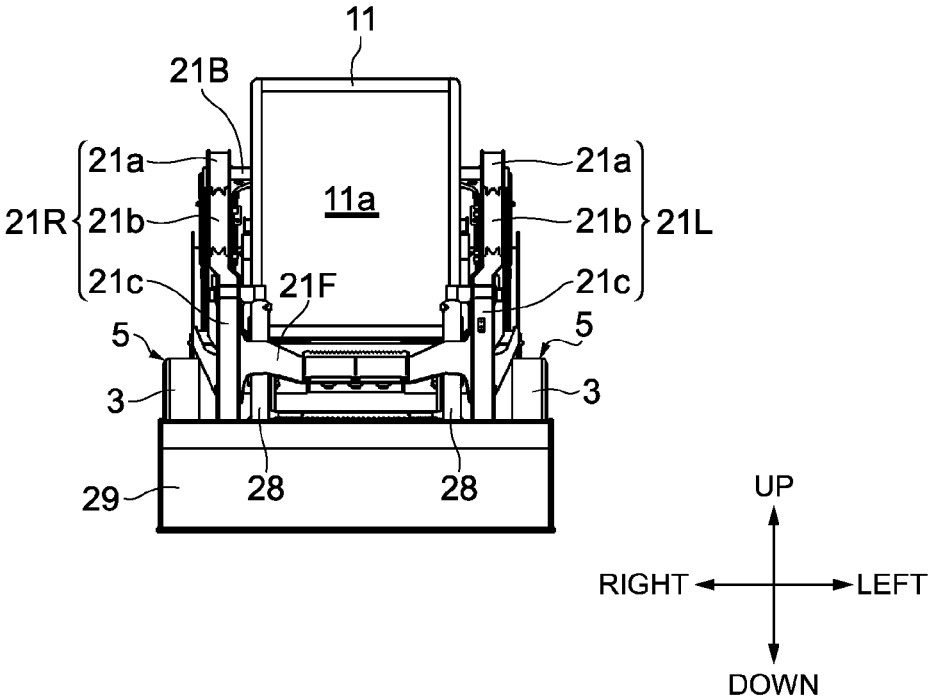

As illustrated in FIG. 1, the crawler loader 1 is configured to include: a pair of left and right running devices 5 configured to have an endless belt 3; a main body frame 9 provided with the running devices 5 on the left and right sides thereof; a loader device 20 installed on the main body frame 9; and an operator cabin 11 provided on a center upper part of the main body frame 9. The running devices 5 and the main body frame 9 will hereinafter be collectively referred to as a "vehicle 10".

The operator cabin 11 is formed in a box shape, is opened on the vehicle front side, and is provided with an openable/closable front door 11*a* on the opening part. An operator seat (not illustrated) on which an operator is seated by facing the vehicle front side is provided in the operator cabin 11. On the left and right sides of the operator seat, there are arranged operation levers (not illustrated) for operating the drive of the running devices 5 and the loader device 20.

As described above, the loader device 20 is installed on the main body frame 9. On the main body frame 9, there are provided a plurality of pivotal connection points for installing the loader device 20. Specifically, there are provided: a pivotal connection point A located on each of left and right sides of the operator cabin 11 and above the running devices 5; a pivotal connection point B located below and on a rear side of the pivotal connection point A; and a pivotal connection point C on a rear side of the pivotal connection point B, below the pivotal connection point A, and above the pivotal connection point B.

The loader device 20 is configured by: an arm 21 arranged to surround front, rear, left, and right sides of the cabin 11; a pair of left and right control links 22 installed to stride over the main body frame 9 and the arm 21; a pair of left and right arm cylinders 23 installed to stride over the main body frame 9 and the arm 21 on a rear side of the control links 22; a pair of left and right lift links 24 installed to stride over the main body frame 9 and the arm 21 on a rear side of the arm cylinders 23; and a bucket 29 installed on a front end part of the arm 21 via a bracket 29*a*. The control links 22, the arm cylinders 23, and the lift links 24, each in the pair on the left and right sides respectively are symmetrically provided. The arm 21 is installed on the main body frame 9 via the control links 22, the arm cylinders 23, and the lift links 24.

The arm 21 includes: a left arm 21L located on a left side of the operator cabin 11 and extended longitudinally; a right arm 21R located on a right side of the operator cabin 11 and extended longitudinally; a front cross member 21F located on a front side of the operator cabin 11 and extended in a left and right direction; and a back cross member 21B located on a rear side of the operator cabin 11 and extended in a left and right direction. The left arm 21L and the right arm 21R are configured by being integrally combined by the front cross member 21F and the back cross member 21B.

The left arm 21L includes, in the order from the rear side in the left side view (refer to FIG. 1): a base end part 21*a* extended longitudinally, and also extended downward at the longitudinally intermediate portion thereof; an intermediate part 21*b* extended forward from a front part of the base end part 21*a*; and a front end part 21*c* extended forward from a front part of the intermediate part 21*b* and also bent downward. The base end part 21*a*, the intermediate part 21*b*, and the front end part 21*c* are integrally combined. On the base end part 21*a*, as illustrated in FIG. 1, there are formed: a pivotal connection point D at a lower end part of a portion formed by being extended downward; a pivotal connection point E located above and on a rear side of the pivotal connection point D; and a pivotal connection point F located above and on a rear side of the pivotal connection point E. As illustrated in FIG. 1, in the state in which the arm 21 moved downward, the pivotal connection point D is located slightly below the pivotal connection point A on a rear side of the pivotal connection point A, the pivotal connection point E is located substantially immediately above the pivotal connection point B, and the pivotal connection point F is located substantially immediately above the pivotal connection point C. A pivotal connection point G is formed on a top end part of the front end part 21*c*. The right arm 21R is symmetrical with the left arm 21L, and has basically the same configuration as that of the left arm 21L, and therefore, a description of the configuration will be omitted.

Each control link 22 has one end pivotally connected to the pivotal connection point A of the main body frame 9, and has the other end pivotally connected to the pivotal connection point D of the arm 21 (the base end part 21*a*). In this way, each control link 22 is installed to stride over the main body frame 9 and the arm 21. Based on a positional relationship between the pivotal connection point A and the pivotal connection point D described above, at the lowest moving position illustrated in FIG. 1, the control link 22 is arranged to be extended longitudinally in the state in which the rear end is slightly lowered than the front end. Further, in the longitudinally extended state of the control link 22, the total of the control link 22 is located higher than the pivotal connection points B and C, and is also located lower than the pivotal connection point E and the pivotal connection point F.

Each arm cylinder 23 is configured by a hydraulic cylinder in which a cylinder rod expands and contracts in a cylinder tube by receiving supply of a hydraulic pressure. An end part on the cylinder tube side is pivotally connected to the pivotal connection point B of the main body frame 9, and an end part on the cylinder rod side is pivotally connected to the pivotal connection point E (the base end part 21*a*) of the arm 21 so that the arm cylinder 23 is installed to stride over the main body frame 9 and the arm 21. Based on a positional relationship between the pivotal connection point B and the pivotal connection point E described above, the arm cylinder 23 is extended in an approximately vertical direction at the lowest moving position illustrated in FIG. 1, and is also arranged between each control link 22 and each lift link 24.

Each lift link 24 is formed in an approximately L shape in a side view. A lower end of the lift link 24 is pivotally connected to the pivotal connection point C of the main body frame 9, and an upper end of the lift link 24 is pivotally connected to the pivotal connection point F of the arm 21 (the base end part 21*a*) so that the lift link 24 is installed to stride over the main body frame 9 and the arm 21. Based on a positional relationship between the pivotal connection point C and the pivotal connection point F described above, the lift link 24 is extended to a vertical direction at the lowest moving position illustrated in FIG. 1. In the same manner as the left arm 21L, the right arm 21R is also installed on the right side of the main body frame 9 via the control link 22, the arm cylinder 23, and the lift link 24, respectively for the right arm 21R.

Figure 3:
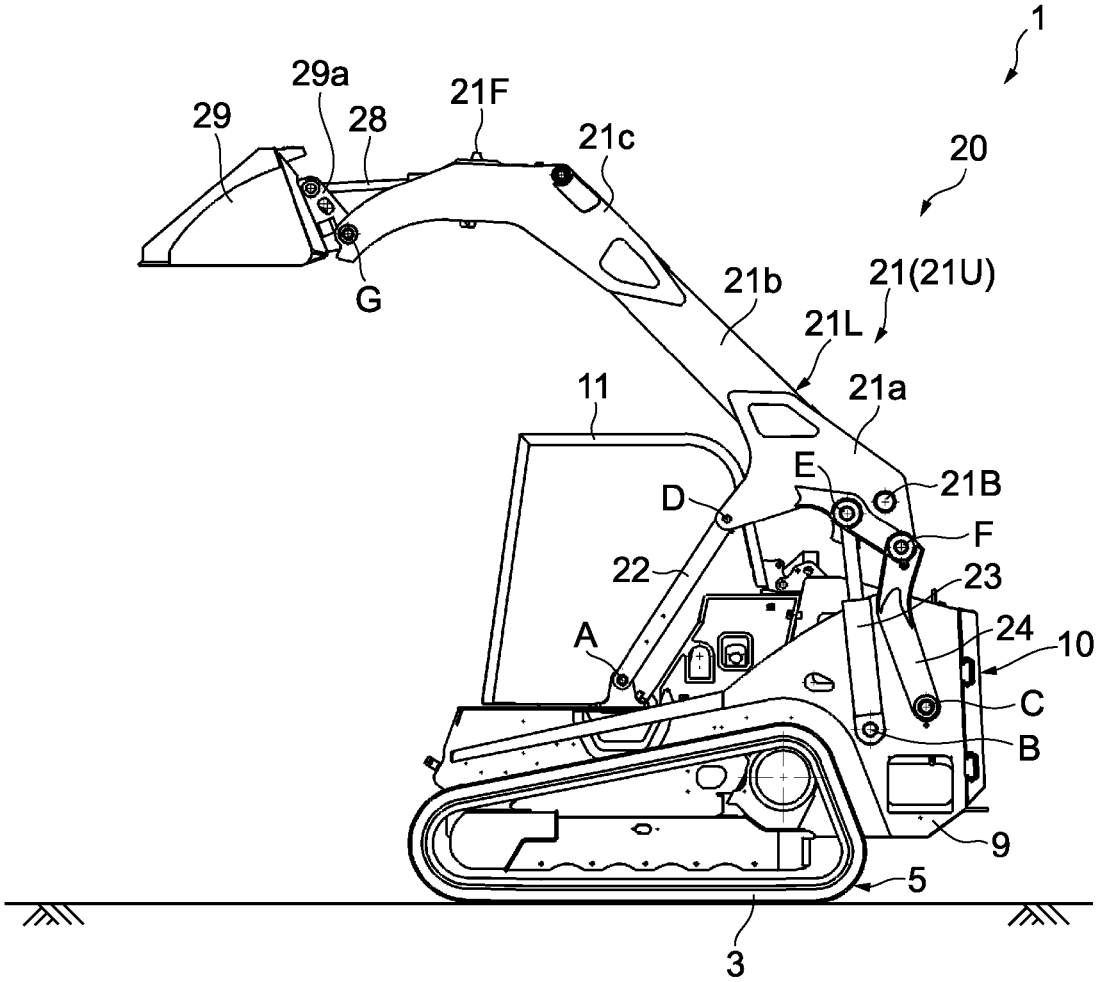
FIG. 3 is a left side view of the skid steering loader illustrating a state in which the arm is oscillated at an uppermost moving position.
Figure 3:
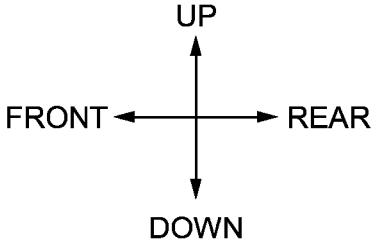

On the pivotal connection point G of the arm 21 (the front end part 21*c*), the bracket 29*a* is pivotally connected vertically oscillatably, and the bucket 29 is detachably installed on the bracket 29*a*. The bracket 29*a* (the bucket 29) is vertically oscillated around the pivotal connection point G by expanding and contacting bucket cylinders 28 provided on the front end part 21*c*. In FIGS. 1 and 3, to facilitate the understanding of the control links 22, the arm cylinders 23, and the lift links 24, these units are illustrated when viewed from the left side of the vehicle. However, actually, these units are covered with side part frames 9*a* on the left and right sides (refer to FIG. 4).

By expanding and contracting the arm cylinder 23, the arm 21 can be oscillated vertically between a lowest moving position of the arm 21 at which the bucket 29 is brought into contact with the ground surface (a position illustrated in FIGS. 1, 2A, and 2B, and the arm 21 at this position will be referred to as an arm 21D in the description) and an uppermost moving position of the arm 21 to which the top end part of the arm 21 is oscillated above the operator cabin 11 (a position illustrated in FIG. 3, and the arm 21 at this position will be referred to as an arm 21U in the description) (to be described in detail later).

Figure 4:
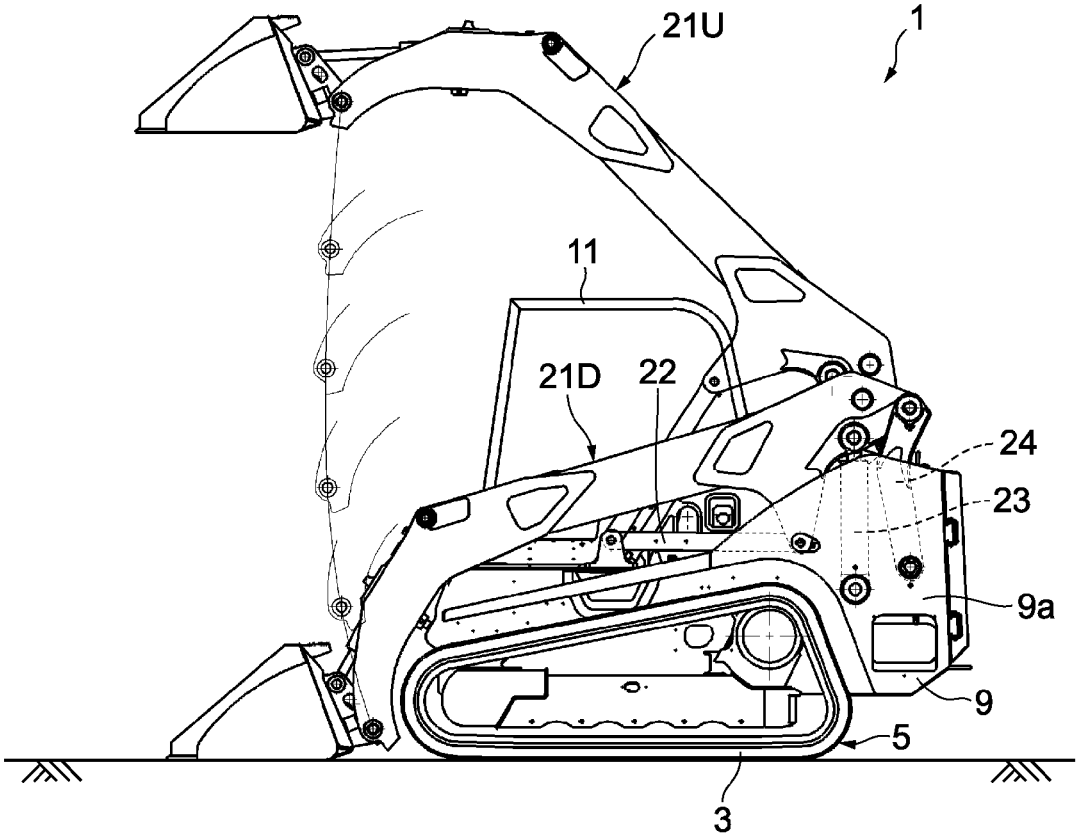
FIG. 4 is a left side view of the skid steering loader for explaining a movement locus of an arm front end.
Figure 4:
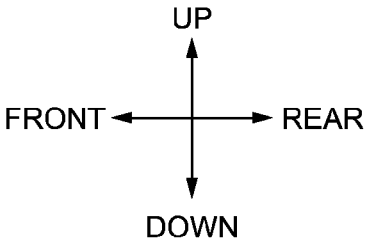

According to the crawler loader 1 configured as described above, by operating the operation levers by the operator seated on the operator seat, it is possible to drive the running devices 5 to run the vehicle, expand and contract the arm cylinders 23 to oscillate the arm 21 vertically, and expand and contract the bucket cylinders 28 to oscillate the bucket 29 vertically, according to the operation of the operation levers. By expanding and contracting the arm cylinders 23, as illustrated in FIG. 4, the arm 21 can be vertically oscillated between the lowest moving position 21D and the uppermost moving position 21U. The vertical oscillation of the arm 21 at this time will be described in detail below with reference to FIG. 5.

Hereinafter, the vertical oscillation of the arm 21 will be described by assuming a case where, by expanding and contracting the arm cylinders 23, the arm 21 is oscillated from the lowest moving position 21D toward the uppermost moving position 21U. In this case, the control link 22 is pivotally connected to the main body frame 9 at the pivotal connection point A, and is rotatable around the pivotal connection point A. Therefore, when the control link 22 is rotated around the pivotal connection point A, the pivotal connection point D connecting the control link 22 and the arm 21 moves on an arc with the control link 22 as its radius and centered on the pivotal connection point A. On the other hand, the lift link 24 is pivotally connected to the main body frame 9 at the pivotal connection point C, and is rotatable around the pivotal connection point C. Therefore, when the lift link 24 is rotated around the pivotal connection point C, the pivotal connection point F connecting the lift link 24 and the arm 21 moves on an arc with the lift link 24 as its radius and centered on the pivotal connection point C. Accordingly, when the arm cylinder 23 is expanded and contracted, the pivotal connection point D moves on an arc centered on the pivotal connection point A, and the pivotal connection point F moves on an arc centered on the pivotal connection point C, with a distance between the pivotal connection point D and the pivotal connection point F maintained constant. Corresponding to the pivotal connection point D and the pivotal connection point F that move in this way, the arm 21 is oscillated upward by changing the inclination to the longitudinal direction and the position in the longitudinal direction.

Figure 5:
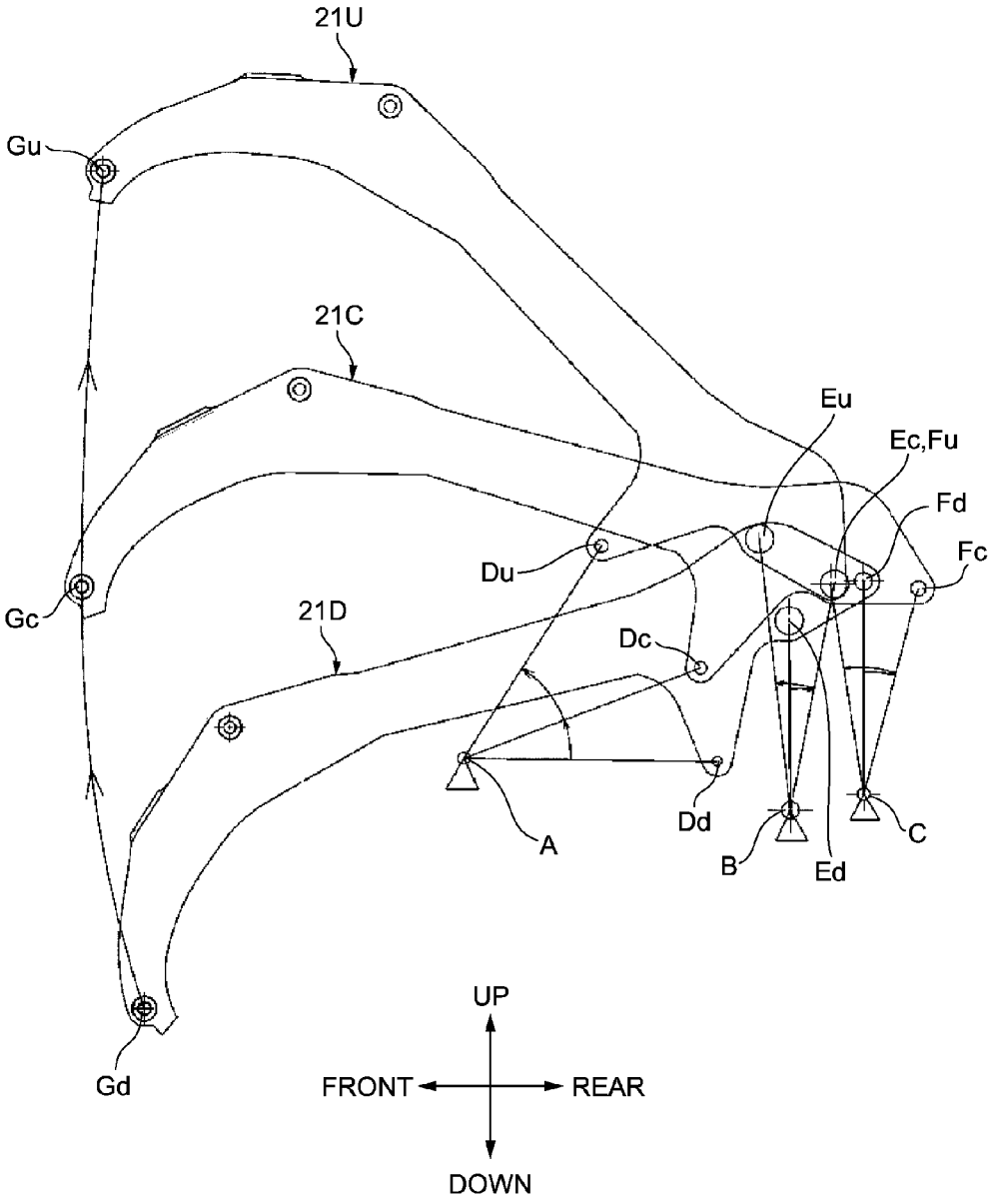
FIG. 5 is a skeleton diagram of the skid steering loader illustrating states in which the arm is located at a lowest moving position, an intermediate position, and an uppermost moving position, and a movement locus of the arm front end.

In FIG. 5, the pivotal connection points D, E, F, and G in the state in which the arm 21 is located at the lowest moving position 21D are indicated as pivotal connection points Dd, Ed, Fd, and Gd, respectively. When the arm cylinder 23 is expanded in this way in the state in which the arm 21 is located at the lowest moving position 21D, the pivotal connection point D moves toward the upper front side on an arc centered on the pivotal connection point A, and the pivotal connection point F moves backward on an arc centered on the pivotal connection point C, with a distance between the pivotal connection point D and the pivotal connection point F maintained constant. At this time, the arm cylinder 23 is oscillated backward around the pivotal connection point B. Accordingly, the arm 21 is oscillated upward to a position near the oscillation position where the pivotal connection point D reaches a straight line connecting the pivotal connection point A and the pivotal connection point F (the pivotal connection points A, F, and D are aligned on a straight line), while moving the pivotal connection point G substantially vertically upward on the slightly front side. In FIG. 5, the pivotal connection points D, E, F, and G in the state in which the pivotal connection point D reached on the straight line connecting the pivotal connection point A and the pivotal connection point F are indicated as pivotal connection points Dc, Ec, Fc, and Gc, respectively. A position of the arm 21 at this time will be described as an intermediate position 21C. The lift link 24 is located rearmost at the intermediate position 21C, and is formed in approximately an L shape in the side view so as not to interfere with the rear part of the main body frame 9 when the arm 21 is at the intermediate position 21C.

In this case, the crawler loader 1 has a configuration in which the control link 22 is approximately horizontally extended backward at the lowest moving position 21D, that is, a configuration in which the pivotal connection point D is located in approximately the same height as the pivotal connection point A. Therefore, while the control link 22 is configured to be arranged to be extended upward toward a rear side from the pivotal connection point A, for example, the instantaneous center position of the arm 21 can be lowered in the state in which the arm 21 is moved to near the lowest moving position 21D. In this case, the moving speed of the front end of the arm 21 is defined as a component of a direction orthogonal with a line segment connecting the instantaneous center of the arm 21 and the front end of the arm 21 (the pivotal connection point G). Therefore, by lowering the instantaneous center position of the arm 21 as described above, a horizontal directional component of the moving speed of the front end of the arm 21 can be reduced, whereby the arm 21 can be moved substantially vertically by restricting forward movement of the front end of the arm 21 when oscillating the arm 21 near the lowest moving position 21D. Consequently, stability of the vehicle 10 can be secured.

When the arm cylinder 23 is further expanded in the state in which the arm 21 is located at the intermediate position 21C, the pivotal connection point D moves toward the upper front side on an arc centered on the pivotal connection point A, and the pivotal connection point F moves forward on an arc centered on the pivotal connection point C, with a distance between the pivotal connection point D and the pivotal connection point F maintained constant. At this time, the arm cylinder 23 is oscillated forward around the pivotal connection point B. Accordingly, the arm 21 is oscillated upward until reaching the uppermost moving position 21U. At this time, the front end pivotal connection point G moves vertically upward while very slightly moving backward, at an upper position near the pivotal connection point Gc corresponding to the intermediate position 21C. In FIG. 5, the pivotal connection points D, E, F, and G at the uppermost moving position 21U are indicated as pivotal connection points Du, Eu, Fu, and Gu, respectively. Because the front end pivotal connection point Gu is located in front of the operator cabin 11 in the longitudinal direction, as illustrated in FIG. 4, it is possible to prevent the gravels and the like in the bucket 29 from dropping onto the operator cabin 11.

When the arm 21 is oscillated upward from the lowest moving position 21D to the uppermost moving position 21U in this way, the position of the front end pivotal connection point G draws a smooth locus in a substantially arc shape extending vertically upward. A portion of the arm near the front end pivotal connection point Gc at the intermediate position 21C is located foremost; the front end pivotal connection point Gu at the uppermost moving position 21U is located slightly on a rear side of the front end pivotal connection point Gc; and the front end pivotal connection point Gd at the lowest moving position 21D is located rearmost. The pivotal connection points A to F are provided in the main body frame 9 and the arm 21 such that when vertically oscillating the arm 21, there occurs no interference between the control link 22, the arm cylinder 23, and the lift link 24, that is, there occurs no interference between moving ranges of the control link 22, the arm cylinder 23, and the lift link 24.

The movement locus of the front end pivotal connection point G is determined based on the lengths and arrangement positions of the control link 22, the arm cylinder 23, and the lift link 24 (that is, the arrangement positions of the pivotal connection points A to F). Changes in the locus of the pivotal connection point G according to the vertical oscillation of the arm 21 will be described below with reference to FIGS. 6A to 6C and 7, taking an example of a case where the length of the control link 22 and the pivotal connection point A are changed.

Figure 7:
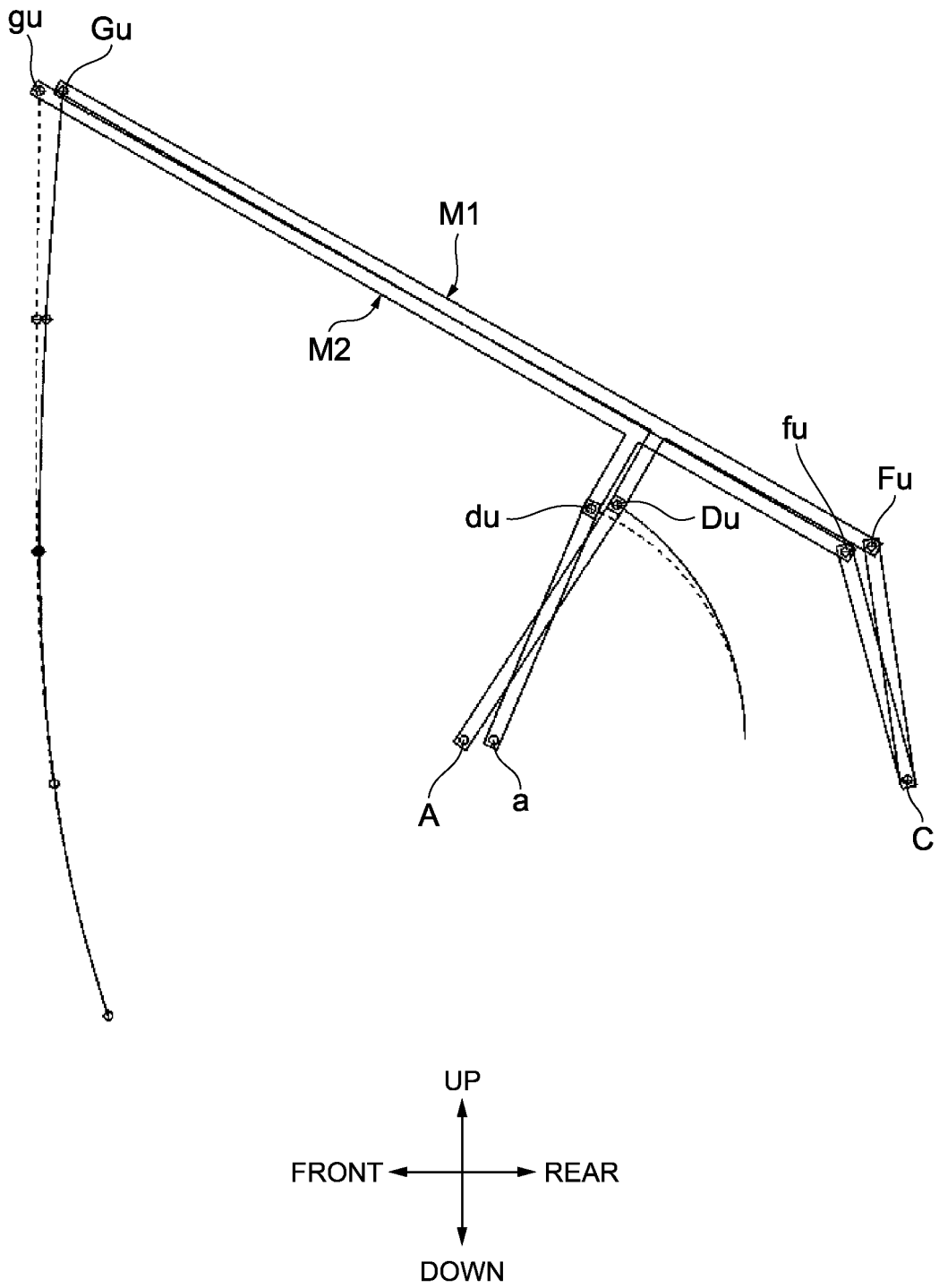
FIG. 7 is a skeleton diagram for explaining a difference in the movement locus of the arm front end following a change in the length of the control link in the vertical type supporting mechanism.

As illustrated in FIG. 6C, a link configuration, in which the pivotal connection point is set to a pivotal connection point a which is shifted backward from the pivotal connection point A between the control link 22 and the main body frame 9, is assumed. First, a link configuration when the pivotal connection point is at the position of the pivotal connection point A as described above is illustrated as a link configuration M1 in FIG. 6A. The front end pivotal connection point G of the arm 21 draws a smooth locus moving vertically upward from the point Gd to the point Gu as described above. On the other hand, when the pivotal connection point is set to the pivotal connection point a (the pivotal connection point is shifted backward from the pivotal connection point A, and the length of the control link 22 is shortened by the shift amount), the front end pivotal connection point G draws a smooth locus moving substantially vertically upward from the point Gd to a point gu as illustrated in FIG. 6B. The two loci are both smooth loci moving substantially vertically upward, but as illustrated in FIG. 7, it is found that the position of the front end pivotal connection point G following the upward oscillation of the arm 21 is different between the two loci in terms of the front rear direction. That is, when the pivotal connection point A is at the pivotal connection point a, the front end pivotal connection point G of the arm 21 (the point of pivotally connecting the bucket 29) is located on the front side.

As described above, it can be understood that depending on a longitudinal position of the pivotal connection point A and the length of the control link 22, there is a change in the locus drawn by the pivotal connection point G when vertically oscillating the arm 21, particularly a longitudinal position of the pivotal connection point G (a longitudinal position of the bucket 29) when the arm 21 is oscillated upward.

The crawler loader 1 configured to be able to vertically oscillate the arm 21 (the bucket 29) in front of the vehicle 10 has a problem in that the crawler loader may overturn forward as the pivotal connection point G (the bucket 29) moves forward in the state in which the arm 21 is oscillated to near the uppermost moving position 21U. On the other hand, when the bucket 29 is located near above the operator cabin 11 in the state in which the arm 21 is oscillated upward, the gravels and the like spilled out from the bucket 29 may drop onto the cabin 11. Therefore, in the crawler loader 1 to which the present invention is applied, a longitudinal position of the pivotal connection point A and a length of the control link 22 are set such that the pivotal connection point G is located at a longitudinal position where the gravels do not drop onto the cabin 11 (specifically, in front of the front end part of the cabin 11) and on the rear side of the front end pivotal connection point Gc at the intermediate position 21C, even when the gravels in the bucket 29 have spilled out in the state in which the arm 21 is oscillated to near the uppermost moving position 21U. The above two problems are solved by this arrangement.

In the case of performing the work of loading the gravels and the like scooped in the bucket 29 onto the dump truck by using the crawler loader 1 configured in this way, in the state in which the arm 21 is oscillated to near the uppermost moving position 21U as described above, because the pivotal connection point G (the bucket 29) is located on a rear side of the front end pivotal connection point Gc at the intermediate position 21C, there is a risk of reduction in the working efficiency due to an increased distance over which the own vehicle is proceeded. Therefore, when performing this work, there is a case where prioritizing the working efficiency is preferable by moving forward the position of the pivotal connection point G (the bucket 29) in the state in which the arm 21 is oscillated to near the uppermost moving position 21U. In this way, there are various requests for the movement locus of the front end of the arm 21 (the bucket 29) according to the work, and there has been desired a configuration capable of changing the movement locus of the front end of the arm 21. There will be described below with reference to FIGS. 8A to 8C a crawler loader capable of changing the movement locus of the front end of the arm 21 by including a locus adjustment mechanism for adjusting a longitudinal position of the pivotal connection point A and a length of the control link 22.

Figure 8A:
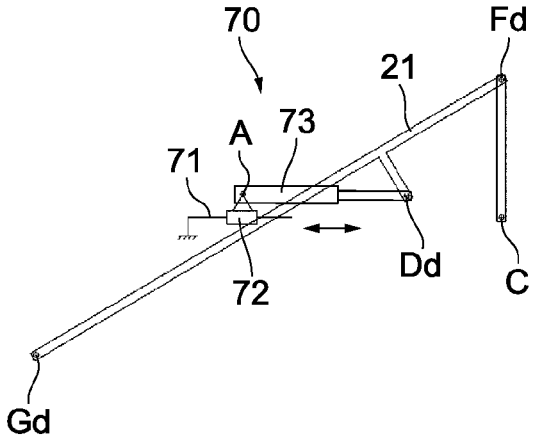
FIGS. 8A, 8B, and 8C are diagrams illustrating a locus adjustment mechanism for adjusting a length of the control link.
Figure 8B:
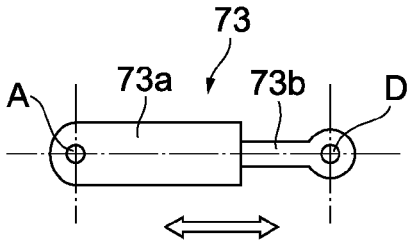
Figure 8B:
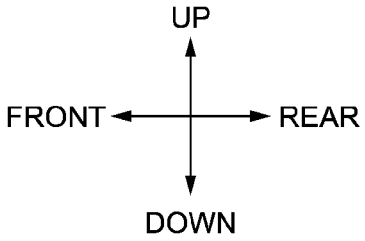

FIG. 8A illustrates a locus adjustment mechanism 70 configured by using an expansion-contraction control link 73 configured to be expandable and contractible in a longitudinal direction, in place of the control link 22 having a constant length in the longitudinal direction. The locus adjustment mechanism 70 is configured to include: a slide rail 71 provided to be extended longitudinally in the main body frame 9; a block 72 in which the pivotal connection point A is formed and which can move longitudinally along the slide rail 71; and an expansion-contraction control link 73 installed so as to stride over the block 72 and the arm 21. As illustrated in FIG. 8B, the expansion-contraction control link 73 is configured to include: a base end part 73*a* pivotally connected to the pivotal connection point A of the block 72; and a front end part 73*b* pivotally connected to the pivotal connection point D of the arm 21 provided to be longitudinally expandable and contractible in the base end part 73*a*.

This expansion-contraction mechanism can be configured by using a screw structure having screws meshed together. That is, a female screw is formed in the base end part 73*a* and a male screw is formed in the front end part 73*b*, and by adjusting the mesh amount of the male and female screws, the length of the expansion-contraction control link 73 can be adjusted. In this case, the block 72 moves by sliding on the slide rail 71 and adjusts a position of the pivotal connection point A so that the pivotal connection point D is not changed.

In this way, the locus adjustment mechanism 70 adjusts a longitudinal position of the pivotal connection point A and the length of the expansion-contraction control link 73 so that the locus drawn by the pivotal connection point G can be changed without changing the position of the arm 21 at the lowest moving position 21D and the angle posture. After the locus adjustment mechanism 70 has once adjusted a longitudinal position of the pivotal connection point A and the length of the expansion-contraction control link 73, the block 72 needs to be fixed onto the slide rail 71. The locus adjustment mechanism 70 includes: a slide lock mechanism (not illustrated) for locking the longitudinally sliding movement of the block 72 during the work of the loader device 20; and an expansion-contraction lock mechanism (not illustrated) for locking the expansion-contraction work of the expansion-contraction control link 73 during the work of the loader device 20.

In order to secure stability, preferably, there is provided a configuration including a work restriction device (not illustrated) that restricts the work of the loader device 20 in the state in which the slide lock mechanism and the expansion-contraction lock mechanism are not working.

Figure 8C:
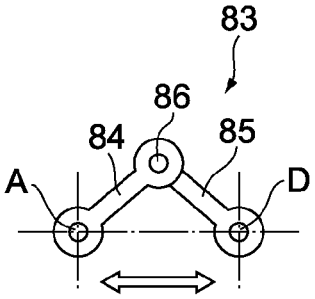

In place of the expansion-contraction control link 73 illustrated in FIG. 8B, there may be provided a configuration using a flexing control link 83 as illustrated in FIG. 8C. The flexing control link 83 is configured by pivotally connecting one end of a base end arm 84 and one end of a front end arm 85 with a pivotal connection point 86. The other end of the base end arm 84 is pivotally connected to the pivotal connection point A of the block 72, and the other end of the front end arm 85 is pivotally connected to the pivotal connection point D of the arm 21. By vertically moving the pivotal connection point 86 by an actuator not illustrated, for example, a longitudinal position of the pivotal connection point A and a length of the flexing control link 83 corresponding to the longitudinal position are set.

The locus adjustment mechanism 70 is provided corresponding to each of the right arm 21R and the left arm 21L. When longitudinal positions of the pivotal connection points A and also lengths of the control links are different respectively between the left and right locus adjustment mechanisms 70, it becomes difficult to smoothly vertically oscillate the arm 21. Therefore, preferably, there is provided a configuration including the work restriction device (not illustrated) that restricts the work of the loader device 20 in the state in which at least one of the longitudinal positions of the pivotal connection points A and the lengths of the control links is different.

The provision of the locus adjustment mechanisms has the following advantages: in the case of performing the work of loading the gravels and the like onto the cargo stand on the carrying vehicle by using the crawler loader, for example, the loading work can be performed efficiently by performing adjustment such that the front end part of the arm 21 (the bucket 29) is located on the front side near the uppermost moving position 21U; on the other hand, in the case of performing the work involving a relatively large load working on the arm front end, for example, stability of the vehicle near the uppermost moving position 21U can be secured by performing adjustment such that the front end part of the arm 21 is located on the rear side near the uppermost moving position 21U.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A working vehicle comprising: a running vehicle capable of running; an arm installed vertically oscillatably on the running vehicle; and a supporting mechanism for vertically oscillatably supporting the arm on the running vehicle, the supporting mechanism including control links that are disposed so as to stride over the arm and the running vehicle, an arm cylinder, and a lift link, and configured to vertically oscillate the arm by expanding and contracting the arm cylinder, wherein pivotal connection points A, B, and C are provided in the running vehicle and respectively connect the running vehicle with one end part of each of the control links, with one end part of the arm cylinder, and with one end part of the lift link, with respect to a vehicle longitudinal direction, the pivotal connection point A is located on a foremost side among the pivotal connection points A, B, and C, the pivotal connection point B is located on a rear side of the pivotal connection point A, and the pivotal connection point C is located on a rear side of the pivotal connection point B, the pivotal connection point B is located below the pivotal connection points A and C with respect to a vertical direction; the pivotal connection point A is located at an intermediate part of the running vehicle in the vehicle longitudinal direction, and the pivotal connection points B and C are located adjacent to each other in a rear part of the running vehicle; and a distance between the pivotal connection point A and the pivotal connection point B is greater than a distance between the pivotal connection point B and the pivotal connection point C, and in a state in which the arm is oscillated to a lowest position, each of the control links is arranged to be approximately horizontally extended backward from one end side where the control link is pivotally connected to the pivotal connection point A, and is pivotally connected to the arm at a pivotal connection point D on the other end side of the control link, the pivotal connection point D being located closest to the pivotal connection point B among the pivotal connection points A, B, and C in absolute distance;

the arm cylinder is located on a rear side of the pivotal connection point D, is arranged to be approximately vertically extended upward from one end side where the arm cylinder is pivotally connected to the pivotal connection point B, and is directly pivotally connected to the arm at a pivotal connection point E on the other end side of the arm cylinder;

the lift link is located on a rear side of the arm cylinder so as to be adjacent to the arm cylinder, is arranged to be extended approximately parallel to the arm cylinder and approximately vertically upward from one end side where the lift link is pivotally connected to the pivotal connection point C, and is pivotally connected to the arm at a pivotal connection point F on the other end side of the lift link; and the pivotal connection points E and F are located above the pivotal connection points A and D with respect to the vertical direction.

2. The working vehicle according to claim 1, wherein the pivotal connection point A is located above the pivotal connection point C with respect to the vertical direction.

3. The working vehicle according to claim 1, wherein in the state in which the arm is oscillated to the lowest position, each of the control links is extended backward and downward from one end side where the control link is pivotally connected to the pivotal connection point A.

4. The working vehicle according to claim 1, wherein in the state in which the arm is oscillated to the lowest position, the pivotal connection point F is located above the pivotal connection point E.

5. The working vehicle according to claim 1, wherein when oscillating the arm from the state in which the arm is oscillated to the lowest position to a state in which the arm is oscillated to an uppermost position via an intermediate oscillation position, a front end part of the arm:

moves forward following upward oscillation of the arm until the arm reaches the intermediate oscillation position from the state in which the arm is oscillated to the lowest position; and moves backward following the upward oscillation of the arm until the arm reaches the state in which the arm is oscillated to the uppermost position from the intermediate oscillation position, and the front end part of the arm in the state in which the arm is oscillated to the lowest position is located on a rear side of the front end part of the arm in the state in which the arm is oscillated to the uppermost position.

6. The working vehicle according to claim 1, further comprising, on left and right sides of the running vehicle, side-part frame members located on outer sides of the arm cylinder and the lift link and configured to cover the arm cylinder and the lift link.

* * * * *